US007264368B2

(12) United States Patent
Sherring

(10) Patent No.: US 7,264,368 B2
(45) Date of Patent: Sep. 4, 2007

(54) HELMET MOUNTED ELECTROLUMINESCENT POSITION INDICATOR

(76) Inventor: Paul David Sherring, 2 The Row Hinton Waldrist, Nr. Faringdon, Oxfordshire (GB) SN7 8RS ( * ) Notice: Subject to any disclaimer, the term of this patent is extended or adjusted under 35 U.S.C. 154(b) by 0 days.

(21) Appl. No.: 10/542,460

(22) PCT Filed: Jan. 15, 2004

(86) PCT No.: PCT/GB2004/000090

§ 371 (c)(1),
(2), (4) Date: Jul. 14, 2005

(87) PCT Pub. No.: WO2004/062410

PCT Pub. Date: Jul. 29, 2004

(65) Prior Publication Data

US 2006/0133068 A1 Jun. 22, 2006

(30) Foreign Application Priority Data

Jan. 15, 2003 (GB) ..... 0300849.7

(51) Int. Cl.
*F21V 21/084* (2006.01)

(52) U.S. Cl. ..... 362/105; 362/84; 362/106; 2/906

(58) Field of Classification Search ..... 362/105, 362/84, 106, 208; 2/205, 206
See application file for complete search history.

(56) References Cited

U.S. PATENT DOCUMENTS 4,186,429 A 1/1980 Johnston
4,195,328 A 3/1980 Harris, Jr.
4,667,274 A * 5/1987 Daniel ..... 362/106
4,862,331 A 8/1989 Hanabusa
4,891,736 A 1/1990 Gouda
5,465,421 A 11/1995 McCormick et al.

(Continued)

FOREIGN PATENT DOCUMENTS

DE 198 55 788 A1 6/2000

(Continued)

OTHER PUBLICATIONS

International Search Report, May 4, 2004.

*Primary Examiner*—Sandra O'Shea
*Assistant Examiner*—Zahra I. Bennett
(74) *Attorney, Agent, or Firm*—Fay Sharpe LLP

(57) ABSTRACT

A position indicator (10) for a helmet (1), for example a bicyclist's safety helmet, comprises a protruberant diffuser (12) containing one or more electroluminescent strips (60, 61); at least part of the emitted light is distributed through the diffuser (12), preferably by means of an internal convex reflector (62) which contains the power supply (70, 71, 72). A second strip is preferably arranged to be directly visible through a transparent window in the diffuser (12). The indicator is releasably attached to the helmet, for example by means of magnets (30), and may be arranged to detach in the event of an accident so as not to impair the normal function of the helmet. The diffuser preferably forms an illuminated band extending along the side of the helmet (1); the front (15) and rear (16) ends of the indicator may be distinguished from each other. A position indicator system comprises two indicators arranged symmetrically on either side of the helmet, so as to indicate the orientation of the wearer.

15 Claims, 7 Drawing Sheets

U.S. PATENT DOCUMENTS

| | | | | |
|---|---|---|---|---|
| 5,469,342 | A | 11/1995 | Chien | |
| 5,479,325 | A | 12/1995 | Chien | |
| D376,469 | S | 12/1996 | Harkness | |
| 5,806,960 | A * | 9/1998 | Chien | 362/84 |
| 5,810,467 | A | 9/1998 | Hurwitz | |
| D448,100 | S | 9/2001 | Husband | |
| 6,457,838 | B1 * | 10/2002 | Dugmore et al. | 362/106 |
| 6,554,447 | B1 * | 4/2003 | Kotary et al. | 362/161 |
| D487,997 | S | 4/2004 | Natuzzi | |
| 6,752,510 | B1 * | 6/2004 | Appiah | 362/106 |
| D509,612 | S | 9/2005 | Amorin | |

FOREIGN PATENT DOCUMENTS

| | | | |
|---|---|---|---|
| DE | 202 09 611 | U | 12/2002 |
| EP | 1 020 325 | A2 | 7/2000 |
| FR | 2 806 680 | A1 | 9/2001 |
| GB | 2 363 314 | A | 12/2001 |
| JP | 11-329003 | | 11/1999 |

* cited by examiner 82
88
81
80
83
84
86
85
87

HELMET MOUNTED ELECTROLUMINESCENT POSITION INDICATOR

CROSS-REFERENCE TO RELATED APPLICATIONS

This application is a national stage entry of international application number PCT/GB2004/000090, having international filing date Jan. 15, 2004, which was published in English, and which claims priority to Great Britain patent application No. GB0300849.7, filed Jan. 15, 2003.

This invention relates to helmet mounted safety lights or indicators for indicating the presence or position of the wearer.

Helmets are protective coverings worn on the head, either in the form of a hat or as part of a protective suit or the like. Examples include safety helmets for cyclists, skateboarders and the like, motorcycle crash helmets, hard hats for builders or miners, airtight, watertight or pressure resistant headcoverings for divers or astronauts, and so forth.

It is often desirable for the user of a helmet to indicate his presence or position to others. For example, a cyclist must ensure that he can be seen by motorists, particularly in adverse conditions; miners must ensure that they are visible to their companions in case of accidents; and so forth.

It has accordingly been proposed to mount an illuminated position indicator or safety light on a safety helmet; for example, U.S. Pat. No. 4,862,331 to Hanabusa discloses a safety light which is releasably attached to the rear of a motorcycle helmet Where the indicator is intended for use on a bicyclist's helmet or the like, it is essential that it should be as light in weight as possible so as to avoid unbalancing the cyclist. An electroluminescent light source is well suited to achieve this objective since it is relatively energy efficient in comparison with conventional light sources, and EP 1 084 635 to Isis Trust, U.S. Pat. No. 5,327,587 and U.S. Pat. No. 5,810,467 to Hurwitz and U.S. Pat. No. 5,559,680 to Tabanera for example accordingly propose helmets with integral electroluminescent lights.

A typical electroluminescent light source comprises a thin, planar sheet or strip which can be mounted on the surface of the helmet and emits light evenly from its exposed flat surface when energised by an alternating current power supply. A further advantage of an electroluminescent light source is the lack of glare normally associated with a conventional light source; this helps to avoid dazzling other road users or observers of the indicator.

Where the indicator is used on a helmet for a bicyclist, motorcyclist, skateboarder, skier or the like, it is essential that it should not compromise the protective function of the helmet in the event of an accident, and in particular in the event that the user falls on his head. Bicycle type helmets in particular (which are used as well by skateboarders, skiers and the like) are very light in weight, and their shell may comprise merely a relatively thick, moulded mass of expanded polystyrene or the like, with voids formed in the moulding which extend entirely through the helmet and which serve to reduce its weight still further while providing ventilation to the user's scalp. The removal of any part of such a helmet in particular, or the intrusion of any components of the indicator into its shell, would unacceptably compromise the impact protection which it offers to the user.

It is also important that the indicator should provide sufficient stored energy to ensure adequate and reliable illumination over an extended period. This ensures that the user (for example, the bicyclist or motorcyclist) remains visible to other road users for the whole duration of an extended trip, which may not offer a convenient opportunity to exchange or recharge the power source. It is important in such a situation that the light source should continue to function effectively until the user has completed his trip, especially since (as the indicator is mounted on the user's helmet) the user is unable to see it directly and therefore may not notice if it stops working.

In some situations it is desirable for a position indicator light to be visible for the greatest possible distance in one direction only. An example is the stop light on a motor vehicle; it is important for following drivers to be aware as early as possible when the vehicle in front brakes, so that they have adequate warning to apply their brakes and avoid a collision. Vehicles travelling in other directions do not require such warning, so indicator lights of this type may include a concave reflector and a lens which together concentrate the light from the light source into a narrow, intense beam which is visible for an extended distance but over a limited viewing angle. Light emitting diodes are often chosen for such applications, and may be manufactured with an integral lens which collimates the emitted light into a beam with an angle of visibility as narrow as five degrees.

In contrast, it is important for position indicators worn by bicyclists, skateboarders, skiers and the like to be visible from the greatest possible viewing angle, since the user may be oriented in any direction with respect to the traffic or other road users. Indeed, it is when a bicyclist is moving relatively slowly and across the flow of traffic, for example when waiting to complete a turn, that he may be most at risk. It is important therefore for such indicators to have the widest possible angle of visibility, which is to say, the widest possible angle within which their light may be observed.

The object of the present invention is to provide a helmet mounted electroluminescent position indicator which is light in weight, is energy efficient, offers the widest possible viewing angle and does not compromise the protection offered by the helmet to the wearer.

According to the present invention there is provided an electroluminescent position indicator for mounting on a helmet, the indicator comprising a body, an electroluminescent light source including at least a first electroluminescent portion, power supply means for powering the light source, and releasable attachment means for mounting a base portion of the body on the helmet;

characterised in that the body includes a protruberant diffuser, and at least part of the light emitted by the first electroluminescent portion is distributed through the diffuser.

Electroluminescent material has an inherently wide viewing angle compared with conventional light sources; however, by simply mounting it flat on the surface of the helmet, a relatively large area of material would be required in order to achieve the maximum possible viewing angle for observers in front and behind the user, as well as above or below. For example, where a bicyclist's helmet is provided with a rim, a sports car driver sitting low on the road might fail to see a flat electroluminescent element mounted just above the rim, particularly if the cyclist's head is tilted. In order to ensure that the indicator is visible over as wide an area as possible, the casing of the indicator is preferably formed as a protruberant, smoothly curved body which in use may be attached to the side of the helmet so that it stands out from the helmet and preferably extends around the curve of the helmet, making it visible both from in front and behind, as well as from above and below.

It is found in practice however to be very difficult or impossible to bend a flat electroluminescent light emitting element so as to conform to a three-dimensionally curved surface, i.e. to bend it about plural axes which are not parallel with one another. Furthermore, in order to power a sufficiently large area of electroluminescent material to cover a protruberant, three-dimensional surface so as to make it visible throughout a wide viewing angle, it would be necessary to provide a relatively large and heavy power source, or otherwise to accept a reduced running time for the indicator before the power source required to be recharged or replaced.

Both of these disadvantages are avoided by the present indicator, by forming the body as a protruberant diffuser—which is to say, a three-dimensional diffuser which in use stands out from the surface of the helmet—over which at least part of the light is distributed, ensuring that the emitted light is visible from the widest possible angle. At least part of the light from the electroluminescent light source, which may be one or more electroluminescent elements, for example a pair of strips of electroluminescent material of equal or different sizes arranged back-to-back, or alternatively for example a single strip folded in half, is preferably distributed by means of a convex reflector over the entire internal surface of the diffuser, which in turn forms substantially the entire visible surface of the indicator in use.

In this specification, "convex" means having a generally outward, protruberant curvature, while "concave" means having a generally inward curvature so as to form a hollow.

Desirably, by arranging a second electroluminescent element against the inner surface of the diffuser along a transparent window arranged along its central axis, a central stripe of higher intensity light is emitted directly through the transparent window which emphasises the distinctive shape and orientation of the indicator and hence indicates the orientation of the user. This assists the observer to appreciate the likely direction of movement of the user, as well as the direction in which he is facing, while the more concentrated beam from the second element ensures that the indicator is more visible at distance and in conditions of poor visibility such as fog.

The protruberant casing thus maximises the visibility of the indicator while the use of a diffuser and, preferably, a cooperating reflector or lens/reflector combination to distribute the light from a relatively small portion of electroluminescent material over the extensive three-dimensional surface of the casing, maximises its energy efficiency.

However, where the helmet is used by a bicyclist, motorcyclist or the like, in the event that the wearer of the helmet should suffer a fall and strike his head, the protruberant casing if fixed permanently to the helmet could cause a wrench to the wearer's neck, compromising the protection offered by the shell of the helmet which, typically, will be smoothly curved so as to allow the user to roll out of a fall.

For this reason, where the indicator is intended for use on a cyclist's or motorcyclist's helmet or the like, it is provided with a breakaway attachment means which automatically detach the indicator on impact. Preferably, magnetic attachment means are used, as it is found that cooperating magnetic elements (such as, for example, magnets and steel plates) arranged respectively on the base portion of the indicator body and on the helmet offer the most predictable and controllable release characteristics. The element which remains attached to the helmet is preferably a thin plate or the like, which ensures that the smooth contours of the helmet are not broken and its protection is effectively unimpaired.

The invention thus offers an electroluminescent position indicator which provides a remarkably wide viewing angle and high level of effective visibility, combined with surprisingly low power consumption relative to its effective visibility, and a correspondingly extended period of operation without requiring recharge or replacement of the power source. Its high energy efficiency or limited power consumption enable a relatively small battery pack or other power source to be used, together with a relatively low power electronic drive circuit, minimising the overall weight of the indicator. Furthermore, by arranging the diffuser to form a cavity containing the power supply and the light source, and preferably containing a convex reflector which in turn contains the power supply, all of the power supply components may be arranged within the volume of the diffuser so that despite its protruberant contours, the indicator remains relatively compact and substantially its whole visible surface is illuminated. Since all of the components of the indicator are contained within its body and may be arranged to detach from the helmet on impact, the indicator does not intrude into the helmet.

It is found in practice that the light from the electroluminescent strip is less dazzling and hence more effective as a position indicator than that from a conventional light source. An electroluminescent light source is also found in tests to be more easily visible in fog, and hence is preferred for use in a position indicator. These advantages are particularly apparent in difficult conditions—for example where there is a confusion of point sources of light, where light is diffracted by fog, or in reduced visibility conditions such as may be encountered when diving.

Further features and advantages of the invention are evident from the following description, in which various illustrative embodiments, which are not however intended to limit the scope of the invention, are described by way of example and with reference to the accompanying drawings, in which.

Figure 1:
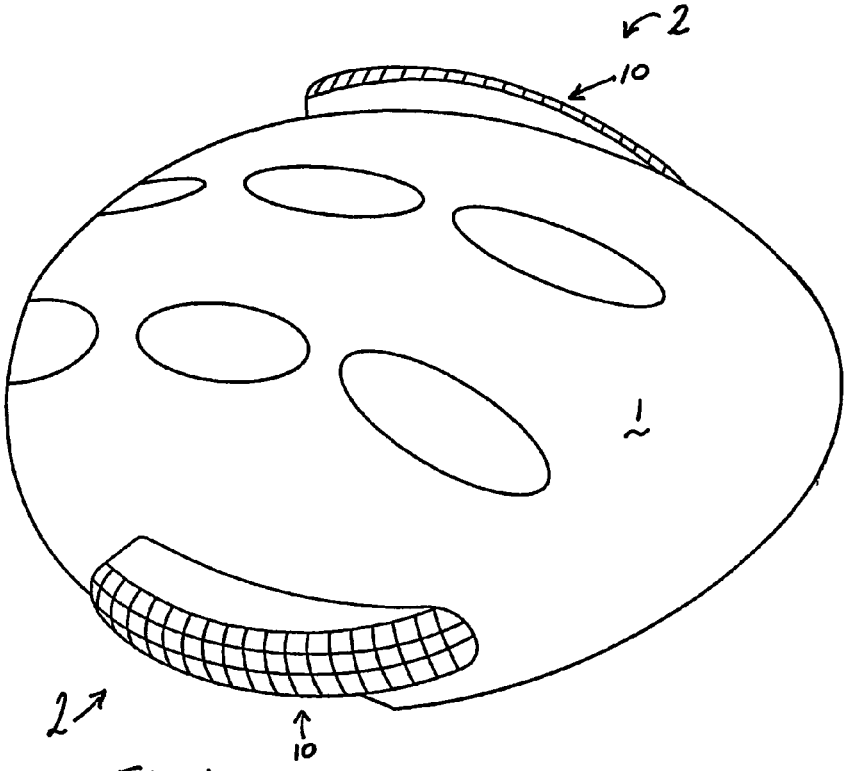
FIG. 1 is a perspective view of a pair of position indicators according to a first embodiment, in use on a cyclist's safety helmet.
Figure 2A:
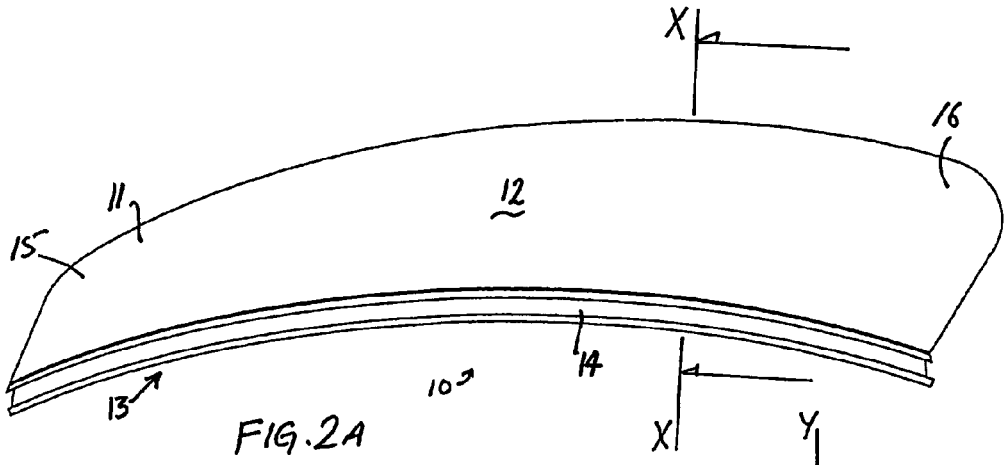
FIGS. 2A and 2B are respectively side and end views of one of the position indicators of FIG. 1.
Figure 2B:
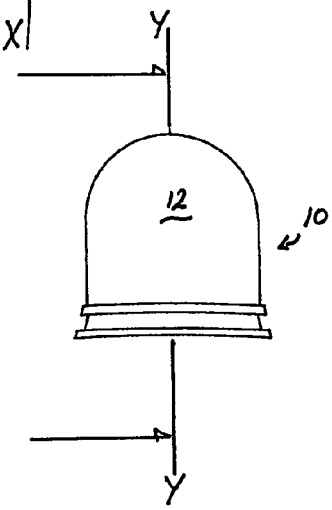

Referring to FIGS. 1, 2A and 2B, in a first embodiment a pair of position indicators 10 are shown in use attached to opposite lateral sides 2 of a cyclists safety helmet 1. Each indicator comprises an elongate body 11 with a protruberant translucent diffuser 12 and a base portion 13; conveniently the diffuser is formed from an injection moulded translucent or transparent plastics material such as polycarbonate, acrylic, styrene, HDPE or the like. The diffuser may be frosted or otherwise finished so as to distribute the incident light evenly. The base portion 13 conforms to the outer contour of the side portion 2 of the helmet on which it is mounted; the radius of curvature of the base portion 13 along its major axis is preferably between 90 mm and 490 mm, and this is found in practice to be suitable for attachment to a wide variety of commonly available helmets. The diffuser forms a cavity which is enclosed at its base portion 13 by a base plate (which is not shown in the sectional view), on which the attachment means are mounted, and which may if required be watertight and pressure resistant, particularly where the indicators 10 are intended to be used by divers.

Figure 6B:
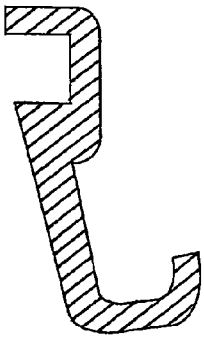
FIG. 6B is a cross section of the seal of FIG. 6A.

A flexible seal 14 (shown in particular in FIG. 6B) is provided on the base portion, which deforms to accommodate differences between the contours of the base portion 13 and the helmet 1 to which the indicator is attached. Depending on the contours of the helmet, the seal may also resist the ingress of water into the junction between the indicator and the helmet, improve streamlining and prevent looseness and vibration during use.

Figure 3:
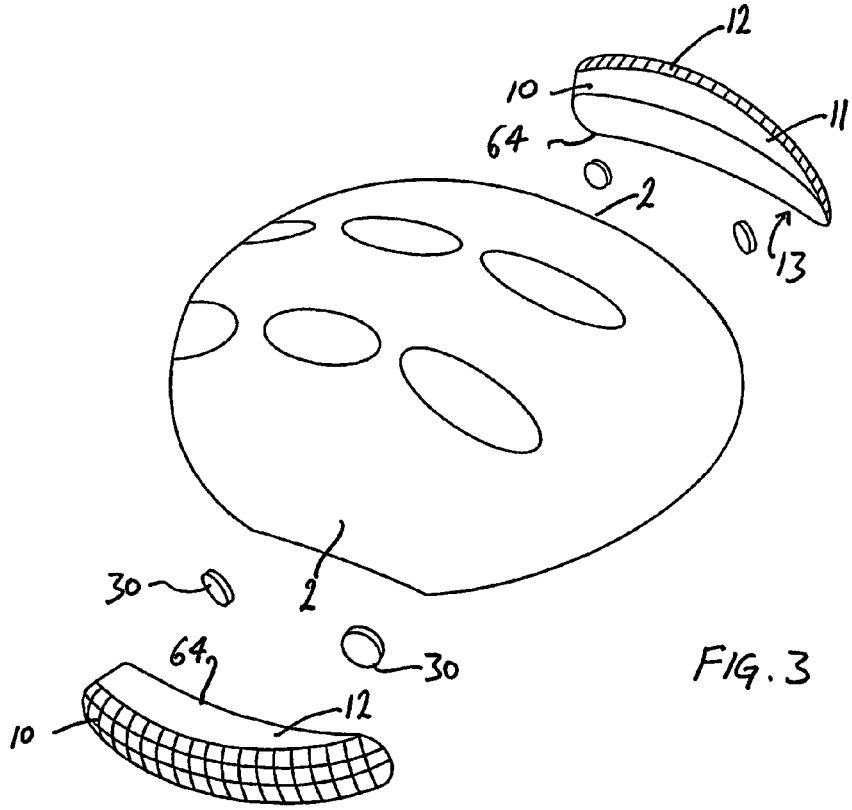
FIG. 3 is an exploded view of FIG. 1 showing the attachment means.

Referring to FIG. 3, each indicator 10 is equipped with releasable attachment means for mounting the base portion 13 on the helmet 1. Conveniently, the attachment means comprise cooperating pairs of slim magnetic elements, which may be disc shaped as shown in the figures, or alternatively for example may be elongate. Each element may be a magnet; alternatively, one element of each pair may be a magnet and the other a steel plate or the like, such as a steel baseplate which may form part of the base portion 13 of the body. One element 30 of each pair is attached to the outer covering of the helmet, for example by double sided high strength adhesive tape, by gluing or welding, and the other (not shown) is arranged within the base portion 13 of the housing 11, for example by moulding it into a plastics plate. Where the element 30 is glued to the helmet, a cyanoacrylate or other adhesive is preferably chosen so as not to adversely affect the plastics shell of the helmet. Where a steel plate is attached to the helmet, double sided adhesive tape offers an effective and convenient means of attachment; the plate is sufficiently thin to conform closely to the surface contour of the helmet so that its protection is unimpaired in the event of an accident.

In use, the base portion 13 is pressed into position so that the cooperating elements attract each other, and the indicator 10 is firmly held against the side of the helmet 1. The indicator 10 may thus be removed cleanly and quickly by grasping it firmly and twisting it away from the helmet, and thereafter reattached to any helmet which is equipped with suitable magnetic elements (or directly to a steel helmet).

In a development, one element of each pair is flexibly attached to the base portion 13, for example by moulding the element into part of the seal 14. The element and seal 14 may be shaped differently from those illustrated. This allows the element to more perfectly align itself with the cooperating element on the surface of the helmet so as to achieve a more positive attachment.

Equivalent attachment means for heavy duty applications will be readily apparent. For some applications, such as builders'or miners' helmets for example, the attachment means may be threaded studs with wingnuts or the like, which ensure that the indicators remain firmly attached in the event of an impact.

However, for other applications, especially cyclists' and motorcyclists' safety helmets, the bulk of the indicator could prevent the helmet from rolling smoothly on the ground in the event of the user falling from the bicycle or motorcycle, resulting in a wrench to the user's neck. It is therefore essential for these applications that the attachment means detach the indicator, and all of its associated power supply components, reliably and instantly in the event of an impact, and this is achieved by the incorporation of the power supply components into the housing, together with the use of suitable releasable, preferably magnetic, attachment elements as described.

In particular, the absence of any restraining element encircling the helmet or substantially protruding from the helmet ensures that the indicators automatically detach themselves cleanly and reliably, enabling the helmet to roll as designed.

Alternatively, equivalent cleanly releasing attachment elements may be used to secure the housing to the helmet. For example, press studs or replaceable frangible elements which are designed to fracture under a specified load might be employed in place of the magnetic elements. Magnetic elements as described are however particularly preferred due to the absence of any component substantially protruding from the helmet subsequent to the detachment of the housing, and because magnetic elements as described achieve particularly reliable detachment under designed impact conditions. Preferably the breakaway force is chosen so as to withstand high wind loading on the body of the indicator as well as the shock loading likely to occur in normal use, while ensuring that detachment automatically occurs at any impact of more than the specified force. The baseplate of the indicator may also be profiled (for example, by curving it or bevelling its edges) to assist detachment, particularly in the event of an impact at a direct rather than tangential angle to the helmet casing.

Figure 4:
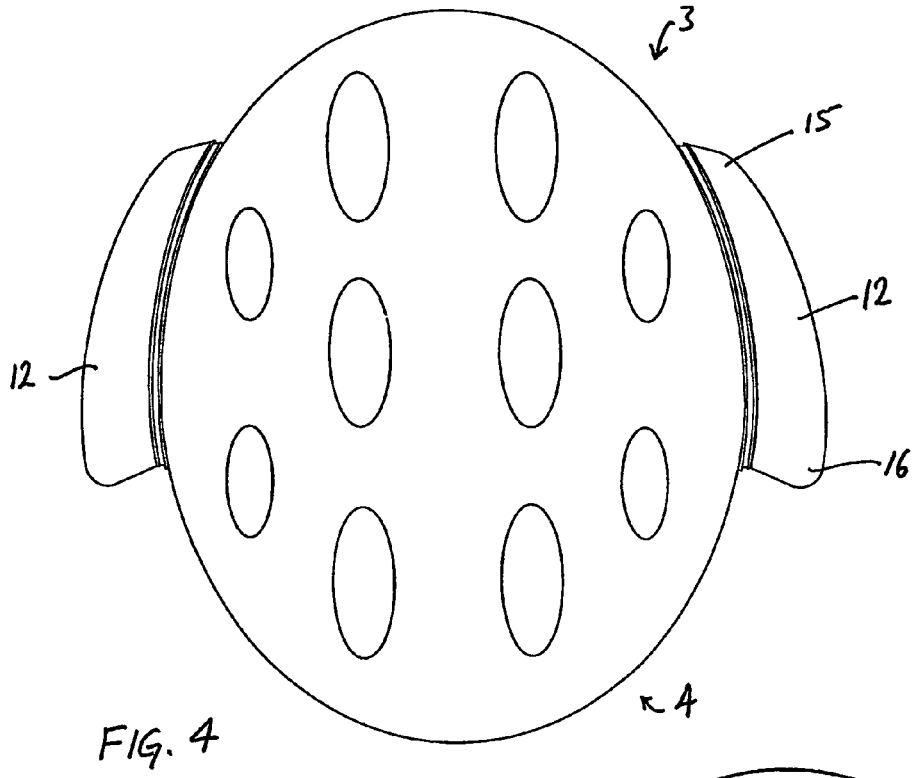
FIGS. 4 and 5 are top views of the indicators of FIG. 1 in use respectively on second and third helmets.
Figure 5:
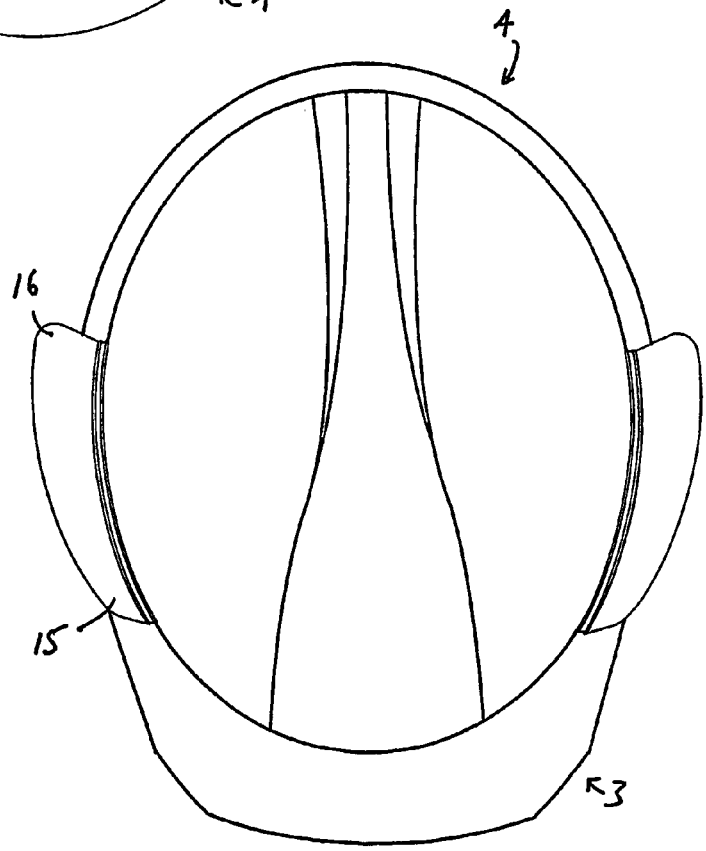

Referring to FIGS. 4 and 5, the indicators 10 are preferably attached in pairs to opposite lateral sides of the helmet so that both indicators are visible together, depending on the position of the observer. The position indicator system thus formed provides a balanced, symmetrical arrangement which does not compromise the balance of the helmet and hence the safety of the wearer. This is particularly important in the case of lightweight helmets, such as those worn by cyclists. Preferably the two sides of each indicator are symmetrical as shown about its major axis so that each indicator may be used on either the right or the left side of the helmet, each of the two sides of the indicator then being respectively either uppermost or downmost.

The diffuser 12 of each indicator forms an elongate band which extends along the side of the helmet from its front part 3 to its back portion 4. This arrangement ensures that the indicators 10 are effective in use, particularly in situations where it is important that the user's presence or position should be clearly visible from the side, such as where the user is a cyclist or motorcyclist riding in conditions of poor visibility and must be clearly seen from the side by motorists who might otherwise manoeuvre into his path. The elongate band of light provided by the indicators 10 gives a clear indication of the presence of the user from each side, in addition to being visible from ahead and behind, and thus offers significant advantages over lights which are visible only from ahead of or behind the user.

The elongate shape of the housing as shown in the figures also streamlines the indicator and minimises drag, which is particularly desirable when the indicator is in use by a cyclist, diver or motorcyclist.

The outwardly extending translucent diffuser of each indicator ensures that the indicator is visible from a wide angle of view, and from above and below as well as to either side, while its elongate shape is easily recognisable, particularly n difficult conditions such as where there is a confusion of point sources of light.

By arranging the pair of indicators on opposite sides of the helmet so that both are visible together, the further advantage is realised that an observer may deduce from the orientation and relative positions of the indicators not only the position but also the orientation and hence the likely direction of movement of the user. Similarly, the observer may deduce the user's field of vision and hence determine whether or not the user is aware of the presence of the observer, or of some impending danger.

In this connection it will be noted that the front end 15 of each indicator 10, which in use is arranged towards the front part 3 of the helmet, is desirably visually distinct from its rear end 16, arranged at the rear end 4 of the helmet. Referring also to FIG. 2A, the distinctive shape of the indicator is visible from above and from the side.

The distinctiveness of the front and rear ends of each indicator, both when observed from in front, behind or to one side of the wearer, and also when seen from above, thus further assists the observer (for example, where the indicators are in use underwater on a diver's helmet) to determine the orientation and direction of movement of the wearer of the helmet. This helps to solve the problem of limited communication between individuals in situations of poor visibility, and makes the indicators more effective in conveying safety critical information about the wearer to his companions.

Figure 6A:
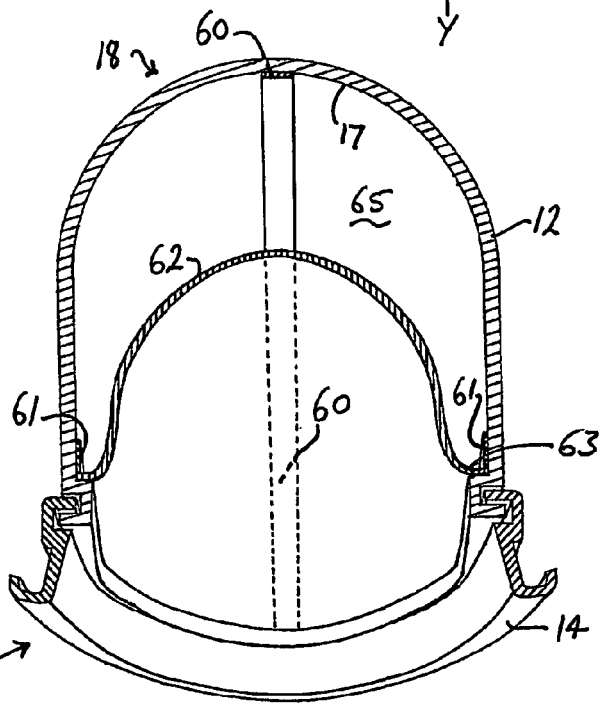
FIG. 6A is a cross section along line X-X of the position indicator of FIGS. 2, with some internal components omitted for clarity.
Figure 7:
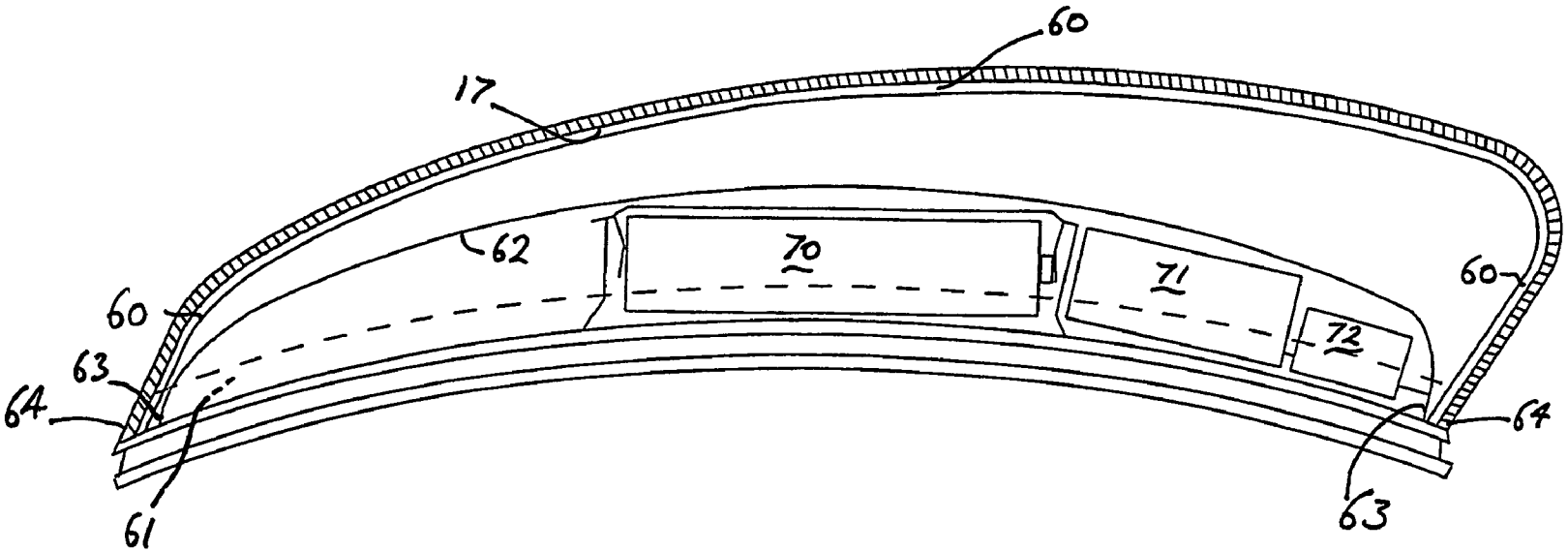
FIG. 7 is a longitudinal section along line Y-Y of the position indicator of FIGS. 2 showing the internal components.
Figure 8A:
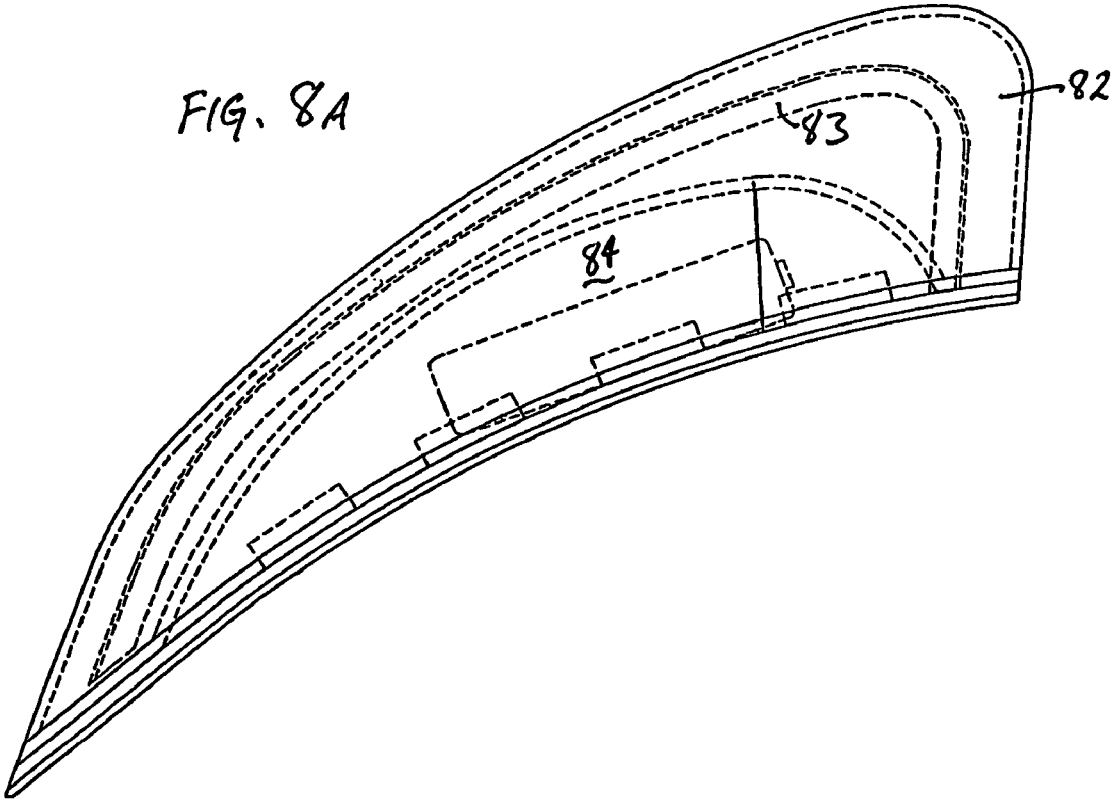
FIGS. 8A and 8B are respectively side and plan views of a position indicator according to a second embodiment, showing its internal components in dotted lines.
Figure 8B:
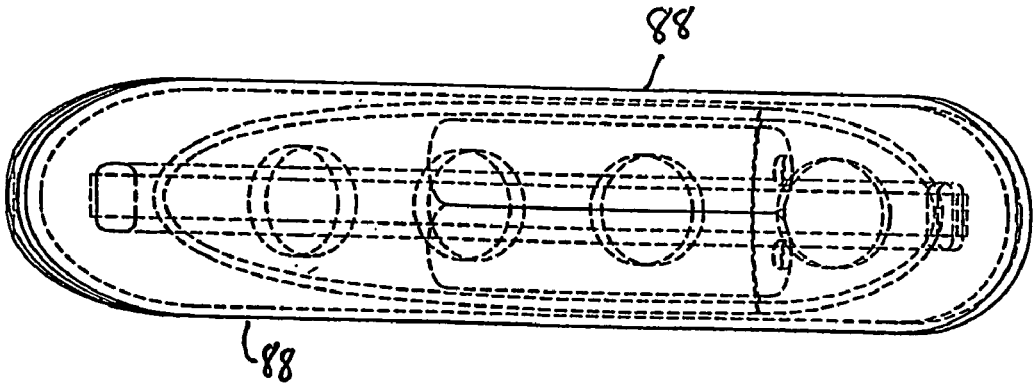
Figure 9:
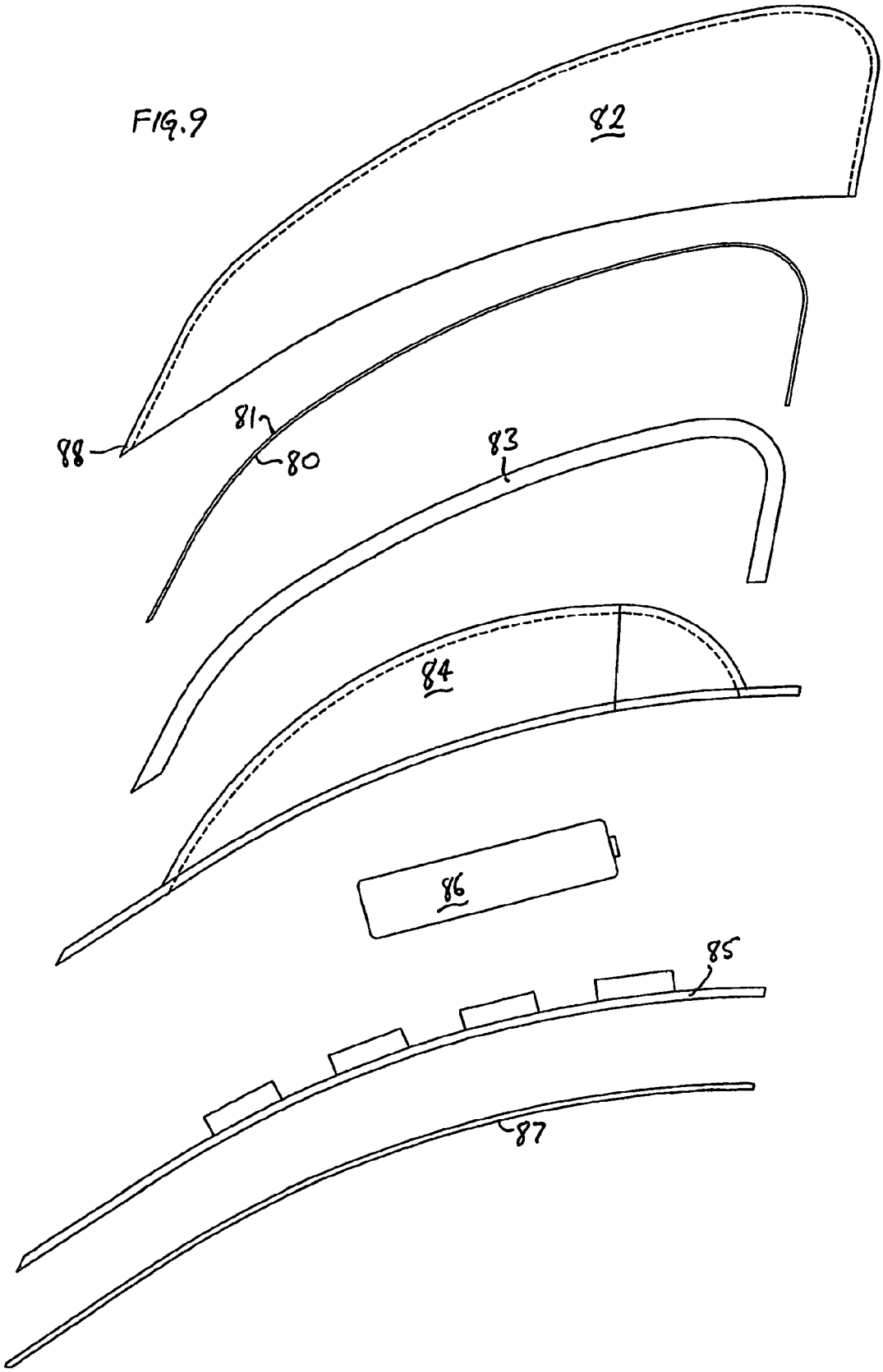
FIG. 9 is an exploded side elevation of the indicator of FIGS. 8A and 8B.
Figure 10:
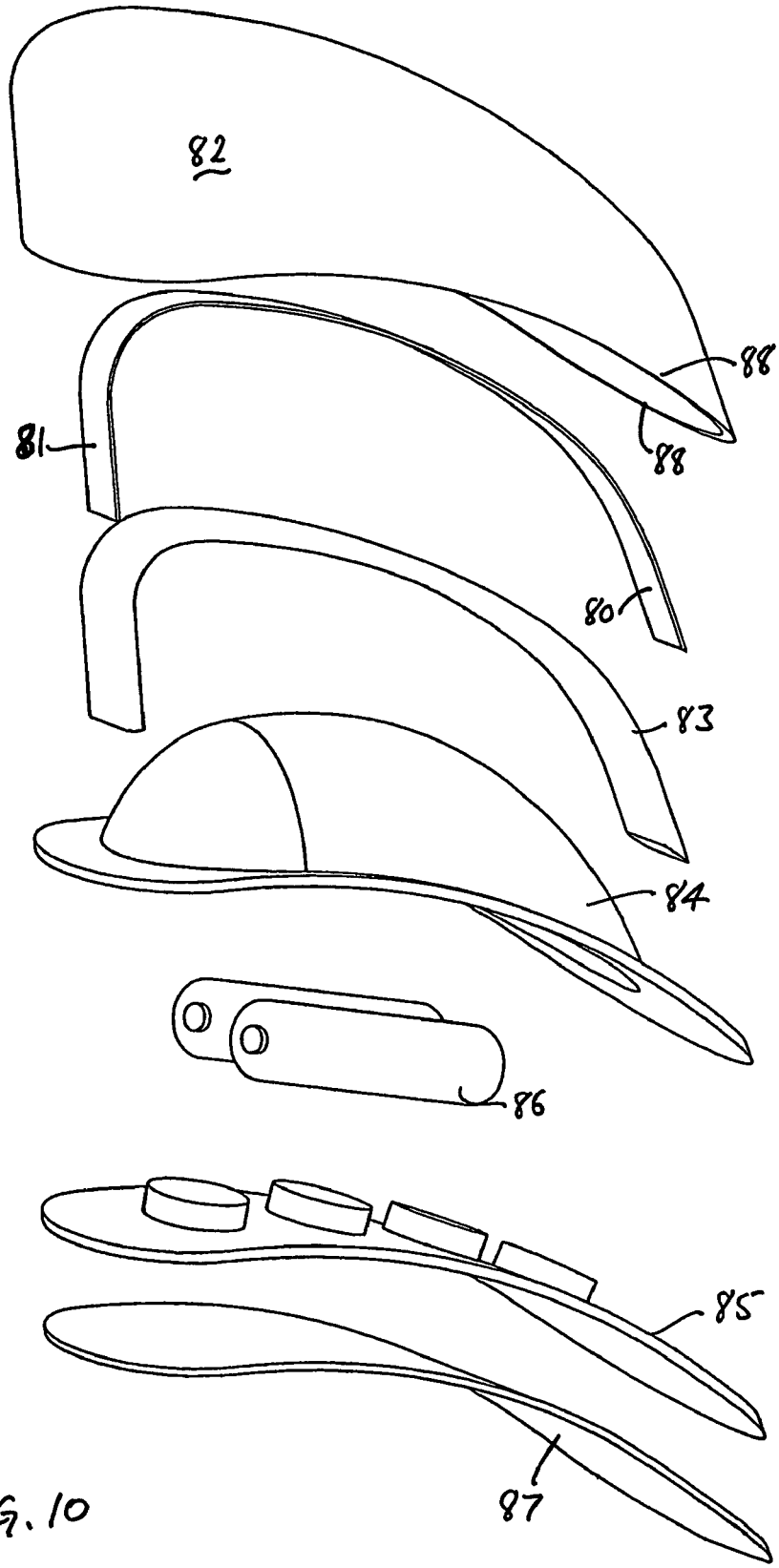
FIG. 10 is an exploded perspective view of the indicator as shown in FIG. 9.

Referring to FIGS. 6A and 7, an electroluminescent light source together with power supply means are arranged within the cavity formed by the diffuser 12. The light source includes a first portion or element of electroluminescent material in the form of a strip 60 about 4 mm wide, which is attached to the inner surface 17 of the outer portion 18 of the housing as shown, or alternatively may be spaced apart from it, so that it runs the full length of the body.

In an alternative embodiment, an electroluminescent strip 61 may be arranged instead adjacent the base portion 13 along one or both sides of the body, as indicated in FIG. 6A and by a broken line in FIG. 7.

In order to maximise the angle of visibility of the indicator, a convex reflector 62 is arranged within the diffuser between the light source 60, 61 and the power supply means 70, 71, 72, and extends substantially away from the base portion 13 so as to define a cavity which contains the power supply means 70, 71, 72. Light emitted from the first electroluminescent element 60 or 61 is distributed by the convex reflector over the internal surface of the diffuser and is thus distributed evenly through the diffuser 12 so that it appears to the observer as a body of light.

The reflector has a continuous encircling peripheral margin 63 which is attached to the diffuser in the region of the continuous encircling peripheral margin 64 of the diffuser, which in use lies adjacent the helmet all the way round, so that a cavity 65 is formed between the reflector and the diffuser which extends substantially over the entire inner surface of the diffuser up to its peripheral margin. This enables the first electroluminescent element 60 or 61 to illuminate substantially the entire visible surface of the body in use.

Both interior and exterior surfaces of the diffuser may be smooth; alternatively its interior surface may be faceted or "frennelled".

It is found that by using a power source (such as one or more batteries) of approximately 3-12V driving a solid state inverter with surface mounted components and a miniature surface mounted coil to form the power supply means 70, 71, 72, it is possible to supply adequate power to the light source to ensure good intensity of illumination for up to 15 hours or more of continuous use, while still achieving a compact and lightweight assembly. Alternative power supply means may be used. The low power requirements of the novel indicator allow the use of miniature surface mount components, which are lighter in weight and more compact than their conventional equivalents but are unable to tolerate high currents.

The base plate may incorporate a compartment containing the battery 70, sealed off from the interior of the housing and incorporating a removable, watertight and pressure resistant lid enabling the battery to be removed and replaced from the outside. The baseplate may be formed as a single moulded plastics component, on which the power supply components are first assembled before sealing it (for example by ultrasonic welding or adhesive) to the diffuser. Alternatively it may be moulded integrally with the diffuser in two parts which are ultrasonically welded together after assembly of the internal components.

Alternatively the power supply components, magnetic elements and battery compartment may be potted in resin which fills the cavity beneath the reflector, sealing the lower margin of the housing, so that the surface of the resin forms the baseplate.

Desirably, a first part of the light emitted by the light source is distributed through the diffuser and a second part of the light emitted by the light source is emitted as a more concentrated beam which is not distributed through the diffuser. This is conveniently arranged by providing a second portion or element of electroluminescent material which is directly visible, for example through a transparent window (which may if required be formed as a lens) in the body of the diffuser, forming a higher intensity, but nevertheless not dazzling band of light, bordered by a more diffuse area of light which is distributed through the diffuser.

In the embodiment described above, the element 60 may accordingly be arranged as a single folded strip or as a pair of elements arranged back to back, with a transparent window formed in the diffuser 12 adjacent the element 60 so that part of the light is emitted directly through the window.

Referring to FIGS. 8A-10, a second embodiment shows this arrangement in more detail.

The light source includes first 80 and second 81 strips of electroluminescent material arranged back to back against the inner surface of the diffuser 82. A transparent window is formed in the diffuser adjacent the second element 81 so that its light is emitted directly through the window. The first element 80 faces the convex reflector and power supply housing 84, which may be moulded in the same material as the diffuser and internally or externally vacuum metalised to a mirror finish. The reflective convex surface of the reflector 84 is highly polished and preferably faceted or frennelled; this breaks up the incident light from the first element 80 and distributes it evenly over the internal surface of the diffuser.

Both elements 80 and 81 are mounted (for example, by adhesive or by mechanically capturing the ends of the strips) back to back on a curved bridge 83, which is conveniently moulded from the same material as the diffuser 82 and which spaces the first strip 80 apart from the reflector 84. The inner surface of the bridge 83 may be formed as a lens, for example, a convex faceted lens, which refracts the light emitted by the first electroluminescent element 80 and distributes it over the reflector 84. The outer surface of the reflector is highly polished and faceted or frennelled, and reflects the incident light evenly across the entire inner surface of the diffuser 82. The power supply components, including a power source such as batteries 86, are contained within the reflector 84. A switch (not shown) is provided in a convenient position.

A base plate 85 is moulded in plastics material to contain a number of magnetic elements, and is attached to the diffuser 82, for example by screwing it directly through the reflector to a protrusion formed on the inside of the reflector, to retain the internal components. A cooperating galvanised steel strip 87, which may be moulded into a plastics strip, is attached to the helmet using double sided adhesive tape or any other convenient means, so that the whole assembly is easily attached to the helmet by offering up the baseplate 85 to the strip 87 so that it is gripped by the magnets. Alternatively a galvanised steel plate may be used as the baseplate, and a thin plastics strip containing thin magnetic elements attached to the helmet.

By using a convex reflector to reflect and distribute part of the emitted light from the single electroluminescent strip 80 onto the whole internal surface of the protruberant diffuser 82, the position indicator achieves an exceptionally wide angle of visibility with only a relatively small area of electroluminescent material, and hence a relatively low power consumption. By arranging the diffuser 82 to extend over the whole visible surface of the indicator so that its peripheral margin 88 lies adjacent the helmet all the way round, the diffused light is distributed over the entire outer casing of the indicator. The indicator thus appears to the observer as an evenly illuminated object with a distinct, elongate shape, emphasised by a central stripe of higher intensity light which is provided by the second element 81 which is directly visible through the transparent window.

Surprisingly, it is found in practice that by distributing part of the light from the electroluminescent light source by means of a convex reflector 84 (rather than concentrating it, as is typically arranged with incandescent or LED light sources, by means of a concave reflector) and emitting it through a diffuser 82, the indicator is more readily visible through a wide viewing angle than a conventional electroluminescent light source of similar power. It is believed that this may reflect a relationship between the response of the human eye and brain to the intensity on the one hand and the spatial extent on the other of the visible light source, so that by optimising this ratio the effective visibility of the electroluminescent light source is maximised.

By combining the enhanced spatial surface area of the protruberant diffuser 82 with the intense strip of light provided by the second electroluminescent element 81, and by arranging the strip 81 so that it lies along the central axis of the diffuser 82, the indicator further enhances the combination of spatial extent and intensity of illumination. It is believed that this combination of a more intense, directly visible electroluminescent light source 81 flanked by an area of diffuse background light offers the most effective level of visibility for the human eye, especially in conditions of poor general visibility, at a given level of power.

Of course, either or both of the electroluminescent elements can be arranged to flash rather than providing a continuous light. Alternative power supply arrangements, such as an integral photovoltaic charger, may also be provided, and where the indicator is not required to detach automatically in the event of impact, a remote power supply may be used.

In summary, embodiments provide a position indicator for a helmet, for example a bicyclist's safety helmet, comprising a protruberant diffuser containing one or more electroluminescent strips; at least part of the emitted light is distributed through the diffuser, preferably by means of an internal convex reflector which contains the power supply. A second strip is preferably arranged to be directly visible through a transparent window in the diffuser. The indicator is releasably attached to the helmet, for example by means of magnets, and may be arranged to detach in the event of an accident so as not to impair the normal function of the helmet. The diffuser preferably forms an illuminated band extending along the side of the helmet; the front and rear ends of the indicator may be distinguished from each other. A position indicator system comprises two indicators arranged symmetrically on either side of the helmet, so as to indicate the orientation of the wearer.

In alternative embodiments the housings need not be elongate, and the electroluminescent light source, and other elements of the invention, may be formed other than as described above. It is to be understood therefore that the invention is not limited to the embodiments described.

The invention claimed is:

1. An electroluminescent position indicator for mounting on a helmet, the indicator comprising:

a body;

an electroluminescent light source including at least a first electroluminescent portion;

power supply means for powering the light source; and attachment means for mounting a base portion of the body on the helmet;

the body including a protuberant diffuser;

at least part of the light emitted by the first electroluminescent portion being distributed through the diffuser;

wherein the diffuser defines a cavity containing the light source and the power supply means.

2. An electroluminescent position indicator for mounting on a helmet, the indicator comprising:

a body:

an electroluminescent light source including at least a first electroluminescent portion:

power supply means for powering the light source; and attachment means for mounting a base portion of the body on the helmet;

the body including a protuberant diffuser;

at least part of the light emitted by the first electroluminescent portion being distributed through the diffuser; and a convex reflector spaced apart from the diffuser for distributing light from the first electroluminescent portion over the diffuser;

wherein the reflector defines a cavity containing the power supply means.

3. An electroluminescent position indicator according to claim 2, wherein the diffuser defines a cavity containing the reflector and includes a peripheral margin which is attached to the base portion of the body such that, when the base portion is mounted on the helmet, the peripheral margin of the diffuser lies adjacent the helmet; wherein the reflector includes a peripheral margin which is arranged adjacent the peripheral margin of the diffuser such that substantially the entire visible area of the body when mounted on the helmet is illuminated.

4. An electroluminescent position indicator for mounting on a helmet, the indicator comprising:

a body;

an electroluminescent light source including at least a first electroluminescent portion;

power supply means for powering the light source; and attachment means for mounting a base portion of the body on the helmet;

the body including a protuberant diffuser;

at least part of the light emitted by the first electroluminescent portion being distributed through the diffuser;

a convex reflector for distributing light from the first electroluminescent portion over the diffuser; and a lens for refracting light from the first electroluminescent portion onto the reflector.

5. An electroluminescent position indicator for mounting on a helmet, the indicator comprising:

a body;

an electroluminescent light source including at least a first electroluminescent portion;

power supply means for powering the light source; and attachment means for mounting a base portion of the body on the helmet;

the body including a protuberant diffuser;

at least part of the light emitted by the first electroluminescent portion being distributed through the diffuser;

wherein a first part of the light emitted by the light source is distributed through the diffuser and a second part of the light emitted by the light source is emitted as a more concentrated beam which is not distributed through the diffuser.

6. An electroluminescent position indicator according to claim 5, wherein the light source includes a second electroluminescent portion, and wherein the first electroluminescent portion emits light through the diffuser and the second electroluminescent portion is directly visible.

7. An electroluminescent position indicator according to any of claims 1, 2, or 5, wherein the attachment means are arranged so as to detach the indicator from the helmet in the event of an impact.

8. An electroluminescent position indicator according to claim 7, wherein the attachment means include cooperating magnetic elements associated respectively with the base portion of the body and with the helmet.

9. An electroluminescent position indicator according to any of claims 1, 2, or 5, wherein the body is elongate and the base portion has a radius of curvature between 90 mm and 490 mm so as to conform to the outer contours of a side portion of the helmet.

10. An electroluminescent position indicator according to claim 9, wherein the diffuser forms an elongate band with a front end and a rear end, and in use the band extends along a side portion of the helmet such that the front end is adjacent a front portion of the helmet, and the rear end is adjacent a rear portion of the helmet.

11. An electroluminescent position indicator according to claim 10, wherein the front end is visually distinct from the rear end in use.

12. A position indicator system for a helmet, the system comprising a pair of electroluminescent position indicators according to claim 10, wherein the indicators are arranged respectively on opposite lateral sides of the helmet.

13. A position indicator system for a helmet, the system comprising a pair of electroluminescent position indicators according to claim 11, wherein the indicators are arranged respectively on opposite lateral sides of the helmet.

14. An electroluminescent position indicator according to any of claims 1, 2, or 5, wherein the base portion includes a flexible seal which in use conforms to the contours of the helmet.

15. A position indicator system for a helmet, the system comprising:

a pair of electroluminescent position indicators according to any of claims 1, 2, or 5, wherein the indicators are arranged respectively on opposite lateral sides of the helmet.

* * * * *